United States Patent [19]

Kurita

[11] Patent Number: 4,534,661

[45] Date of Patent: Aug. 13, 1985

[54] ELECTRIC ALARM WRISTWATCH INCLUDING CYLINDRICAL SOUND TUBE FOR TRANSMITTING SOUND

[75] Inventor: Hirohisa Kurita, Suwa, Japan

[73] Assignee: Kabushiki Kaisha Suwa Seikosha, Tokyo, Japan

[21] Appl. No.: 387,561

[22] Filed: Jun. 11, 1982

Related U.S. Application Data

[63] Continuation-in-part of Ser. No. 178,410, Aug. 15, 1980, which is a continuation of Ser. No. 936,997, Aug. 25, 1978, abandoned.

[30] Foreign Application Priority Data

Aug. 25, 1977 [JP] Japan ..... 52-102109

[51] Int. Cl.[3] ..... G04C 24/16

[52] U.S. Cl. ..... 368/250; 368/244; 368/73

[58] Field of Search ..... 368/70, 72, 73, 76, 368/88, 107–109, 244, 243, 250, 255; 340/384 R

[56] References Cited

U.S. PATENT DOCUMENTS

| | | | |
|---|---|---|---|
| 3,447,151 | 5/1969 | Potter | 340/384 R |
| 3,462,943 | 8/1969 | Spadini et al. | 58/57.5 |
| 3,577,876 | 5/1971 | Spadini | 58/57.5 |
| 3,638,418 | 2/1972 | Spadini | 58/57.5 |
| 3,670,321 | 6/1972 | Savides | 340/384 |
| 3,760,583 | 9/1973 | Tsuruishi | 58/57.5 |
| 3,846,792 | 11/1974 | Haigh | 340/384 E |
| 3,879,931 | 4/1975 | Yasuda et al. | 58/38 |
| 4,180,970 | 1/1980 | Tokunaga et al. | 368/243 |
| 4,206,590 | 6/1980 | Fukutome et al. | 368/72 |
| 4,391,532 | 7/1983 | Hara | 368/72 |

FOREIGN PATENT DOCUMENTS

| | | | |
|---|---|---|---|
| 761850 | 3/1934 | France | 340/384 R |
| 197808 | 8/1978 | United Kingdom | 58/57.5 |
| 2022879 | 12/1979 | United Kingdom | 368/285 |

*Primary Examiner*—Bernard Roskoski
*Attorney, Agent, or Firm*—Blum Kaplan Friedman Silberman & Beran

[57] ABSTRACT

An electronic alarm wristwatch including a wristwatch case with a time display and an alarm buzzer therein wherein the display overlaps at least a portion of the alarm buzzer is provided. The alarm buzzer is positioned in a sound member in registration with buzzer openings in the watchcase for directing the buzzer sound to the time display side of the wristwatch. By overlapping the time display and buzzer, the size of the time display area may be increased without increasing the overall size of the wristwatch.

9 Claims, 6 Drawing Figures

ELECTRIC ALARM WRISTWATCH INCLUDING CYLINDRICAL SOUND TUBE FOR TRANSMITTING SOUND

CROSS-REFERENCE TO RELATED APPLICATIONS

This application is a continuation-in-part of application Ser. No. 178,410, filed on Aug. 15, 1980 which is a continuation of application Ser. No. 936,997, filed on Aug. 25, 1978, and now abandoned.

BACKGROUND OF THE INVENTION

This invention relates generally to an electric alarm wristwatch including a time display and an alarm buzzer. In conventional alarm wristwatches which include a buzzer, the buzzer is generally disposed under the display panel with the alarm sound released from the back side of the watch case. In this type of construction, the rear of the watch case is generally formed with a double rear wall for providing a suitable space inside the rear wall to allow the buzzer alarm sound to be emitted on an inclined surface of the rear outer portion of the watch case. The alarm sound is often interrupted by the wearer's arm. Under certain conditions, the holes for emitting the buzzer sound may be covered completely by the wearer's arm so that the sound of the alarm buzzer is extremely low. In this type of construction assembly is complicated as it is necessary to arrange the battery hutch, which allows access to the watch battery, to pass through two rear walls. In addition, the wristwatch becomes thicker because there are two rear watch case walls.

One technique for solving some of the above-mentioned shortcomings is shown in FIG. 1. In this structure the sound of the buzzer is emitted towards the display side of the wristwatch by arranging a digital display panel and the alarm buzzer so as not to overlap each other in plan view. If this type of structure is utilized, many of the above shortcomings can be eliminated. However, the planar space of either the display panel or the buzzer cannot be increased without increasing the overall size of the watch case because the display panel and the buzzer are arranged not to overlap. Therefore, such an improved construction has shortcomings when it is desired to provide a wristwatch which is suitable for use for providing the data necessary in a multifunctional wristwatch including the alarm buzzer. Accordingly, it would be desirable to provide an improved alarm wristwatch construction permitting a display panel of increased area and an alarm buzzer wherein the buzzer sould will not be interrupted by a wearer's wrist without increasing the overall size of the wristwatch.

SUMMARY OF THE INVENTION

Generally speaking, in accordance with the invention, an improved electronic alarm wristwatch including a time display and an alarm buzzer which overcomes the disadvantages of prior conventional alarm wristwatches is provided. The wristwatch includes a watch case having a display side formed with a display opening and an adjacent buzzer opening. A buzzer chamber for receiving the alarm buzzer is overlapped at least in part by the time display. A substantial cylindrical member disposed over the non-overlapped portion and in registration with buzzer openings directs the sound to the display side of the watch.

Accordingly, it is an object of the invention to provide an improved alarm wristwatch.

Another object of the invention is to provide an improved alarm wristwatch having an increased time display region without increasing the overall size of the wristwatch.

A further object of the invention is to provide an improved alarm wristwatch wherein the alarm buzzer sound is not interrupted by the wearer's wrist.

Still another object of the invention is to provide an improved alarm wristwatch wherein the time display overlaps at least a portion of the buzzer, the alarm buzzer sound emitted on the display side of the wristwatch.

Still a further object of the invention is to provide an improved alarm wristwatch which is waterproof.

Still other objects and advantages of the invention will in part be obvious and will in part be apparent from the specification.

The invention accordingly comprises the features of construction, combination of elements, and arrangement of parts which will be exemplified in the construction hereinafter set forth and the scope of the invention will be indicated in the claims.

BRIEF DESCRIPTION OF THE DRAWINGS

For a fuller understanding of the invention, reference is had to the following description taken in connection with the accompanying drawings, in which.

DETAILED DESCRIPTION OF THE PREFERRED EMBODIMENTS

Figure 1:
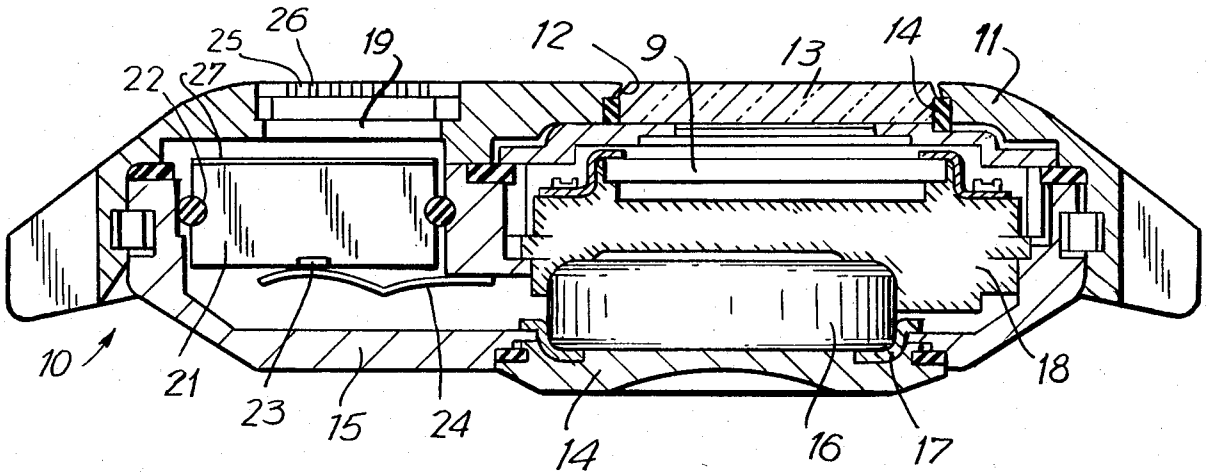
FIG. 1 is a cross-sectional view of an electric alarm wristwatch.

Referring now to FIG. 1, an electro-optical digital display alarm wristwatch shown generally as 10, designed to overcome the disadvantages of the conventional alarm wristwatches wherein the alarm sound is interrupted by the wearer's wrist, is shown. Wristwatch 10 includes a watch barrel or watch case 11 formed with an opening 12 for receiving a cover glass 13 in compressive relation with a glass packing member 14 within opening 12. A watch case back 15 is releasably secured to watch barrel 11 and supports a battery 16 which is retained within the watch case by a holding clip 17 supported on a battery hutch 8 which is releasably mounted in watch case back 15. Battery 16 abuts and is in electrical contact with a watch body 18 which contains the electrical circuits (not shown) for a time digital display 9 disposed over watch body 18 and viewable through opening 12 provided in watch barrel 11.

Watch barrel 11 is formed with a buzzer opening 19 adjacent opening 12 on the display side of watch 10. An alarm buzzer 21 is disposed and retained within watch barrel 11 by a gasket 22. Alarm buzzer 21 is formed with contact 23 (only one is shown) which abuts a terminal 24 (only one of which is shown) for providing electric current to alarm buzzer 21. A buzzer cover 25, formed with a plurality of buzzer cover holes 26 is retained in second opening 19. Alarm buzzer 21 is positioned within watch barrel 11 so that a diaphragm 27 disposed across the top surface of buzzer 21 faces buzzer cover 25 for the transmission of buzzer sound uninterrupted through holes 26.

In the multifunctional electric alarm wristwatches popular today it is easy to use the alarm setting as the alarm time can be set while viewing the present time by displaying both the alarm setting time and the present time in hours, minutes, seconds, date and day of the week. In such a wristwatch, it is necessary to provide a time display panel larger than a conventional display panel. However, if this enlarged display panel is arranged in parallel or non-overlapping relation with the alarm buzzer, as shown in FIG. 1, the wristwatch becomes overly large, looks heavy and is uncomfortable to wear and suffers from an overall poor design. These defects may be overcome by providing a compact alarm wristwatch having a large display panel constructed and arranged in accordance with the invention.

Figure 2:
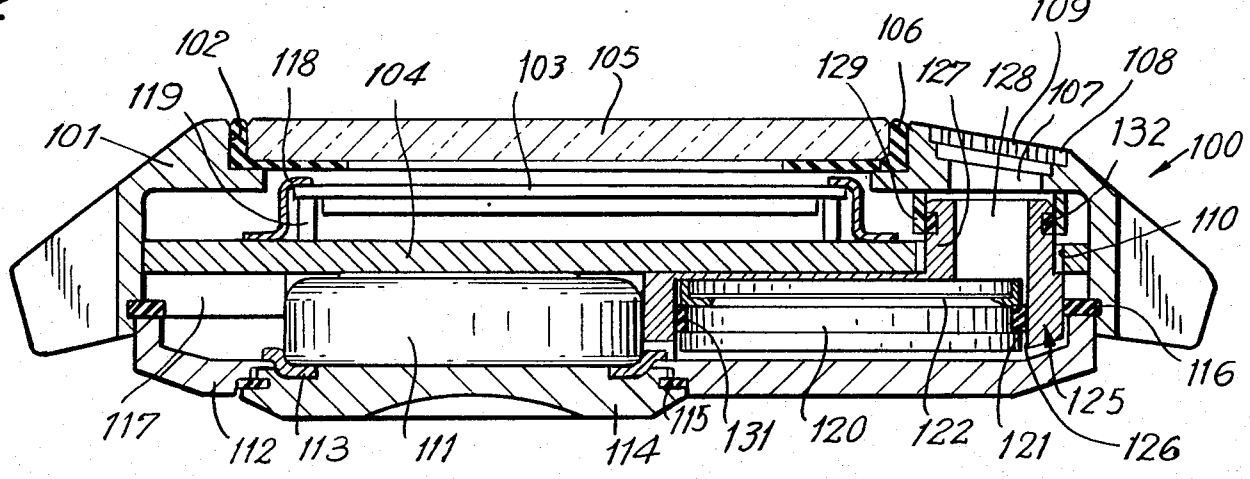
FIG. 2 is a cross-sectional view of an electric alarm wristwatch constructed and arranged in accordance with the invention.

Referring now to FIG. 2, a cross-sectional view of an electric alarm wristwatch, constructed and arranged in accordance with the invention, is shown generally as 100. Watch 100 includes a watch barrel 101 formed with an enlarged display opening 102, for viewing an enlarged display panel 103 fixed on a plate 104 by a retainer 118 and a post 119. Plate 104 is secured within the inner wall of watch barrel 101. Plate 104 is a metal or printed substrate which forms the base plate of the watch movement and is formed with an opening 110 in the region of alarm opening 107. An oscillator (not shown) and an electronic circuit (not shown) of the wristwatch are mounted on plate 104.

A cover glass 105 is compressively retained within display opening 102 by a glass packing 106. Watch barrel 101 is formed with a second smaller alarm sound opening 107 on the display side of watch 100 adjacent to display opening 102. A buzzer cover 108 formed with a plurality of buzzer cover holes 109, is retained in the upper or display surface of watch barrel 101. Opening 107 communicates between the display side of wristwatch 100 and the interior portion of the wristwatch below plate 104 through a retaining ring 129 mounted on watch barrel 101.

A battery 111 is mounted in case 101 from the back and is disposed against the lower surface of plate 104. A watch case back 112 is releasably secured to watch barrel 101 and supports a battery clip 113. A battery hutch 114 releasably secured within case back 112 provides access to battery 111. A battery gasket 115, compressively retained between hutch 114 and case back 112 and a case gasket 116 compressively retained between case back 112 and barrel 101 provide a watertight seal for the rear side of watch 100. A circuit case 117 is mounted in watch barrel 101 abutting battery 111 and aids in positioning battery 111 and supporting plate 104.

An alarm buzzer 120 is positioned within the interior of watch barrel 101 in an alarm case 125 as will be more fully described below. Alarm buzzer 120 is a unitary piece having a substantially cylindrical side wall 121 and a diaphragm 122 disposed across the upper surface thereof. Diaphragm 122 is recessed a short distance from the top side wall 121. Display panel 103 overlaps at least a portion of alarm buzzer 120 in plan view. Alarm buzzer 120 is positioned and retained in alarm sound case 125 which is positioned in the watch barrel. Alarm case 125 transmits buzzer sounds from the region below plate 104 to the buzzer cover holes 109 on the display side of watch barrel 101.

Alarm sound case 125 includes a first large substantially cylindrical buzzer chamber 126 open on its lower surface and a second eccentrically positioned smaller substantially cylindrical sound tube 127. The sound tube 127 is hollow having a substantially cylindrical opening 128 therethrough for communicating with buzzer chamber 126. Alarm sound emitting from buzzer 111 travels from buzzer chamber 126 to opening 107 and buzzer cover holes 109 on the display surface of watch case 101. In the embodiment shown in FIG. 2, sound tube 127 is disposed along the wall of buzzer chamber 126 giving alarm case 126 an L-shaped cross-section through the centers of buzzer chamber 126 and sound tube 127.

Display panel 103 overlaps a substantial portion of alarm buzzer 120 when viewing watch 100 in top plan view. However, wristwatch 100, constructed and arranged in accordance with the invention, does not suffer from the defects common to prior conventional constructions wherein the sound, emanating from a buzzer overlapped by a display panel, is interrupted by the wearer's arm. In the wristwatches constructed in accordance with the invention, the sound emanating from alarm buzzer 120 passes through alarm sound case 125 to the display side of watch 100 by passing around display panel 102 through sound tube opening 122.

Figure 3:
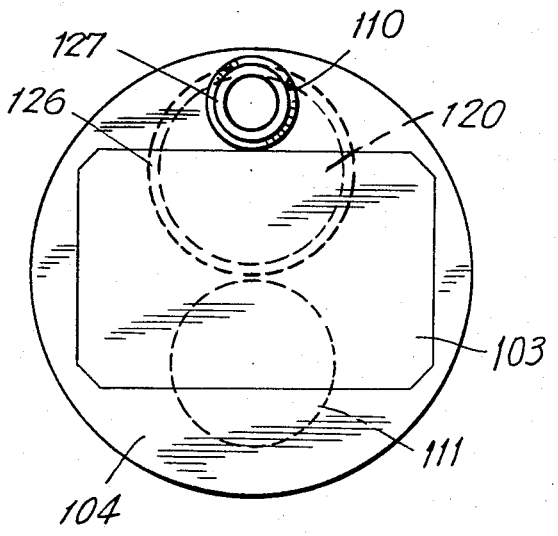
FIG. 3 is a plan view of a supporting plate of the wristwatch depicted in FIG. 2.

Referring now to FIG. 3, a top plan view illustrating the position of the major elements within watch barrel 101 is shown. Display panel 103 is shown overlapping a substantial portion of alarm buzzer 120 and battery 111. By utilizing alarm sound case 125, constructed and arranged in accordance with the invention, sound emanating from buzzer 120 is directed to the display surface of wristwatch 100 by sound tube 127. Alarm sound case 125 is shown disposed in watch barrel 101 below plate 104 so that sound tube 127 passes through opening 110 and reaches the display side of the wristwatch on one of the crescent shaped regions surrounding display panel 103. Accordingly, it can be seen that display panel 103 can be enlarged to its maximum extent within watch barrel 101, yet permit sound to be released through the display side of the wristwatch. Significantly, the overall size of the wristwatch need not be increased in order to obtain this enlarged display area.

In accordance with the invention, it is possible to increase the size of alarm buzzer 120 without increasing the overall size of the face of wristwatch 100 as display panel 103 is disposed over alarm buzzer 120. It is also possible to reduce the thickness of the watch without reducing the volume of alarm buzzer 120. For example, alarm buzzer 120 can be made with the same thickness as battery 111 and a diameter sufficient to fit within the circumference of plate 104 for providing sound of sufficient loudness. As the diameter of diaphragm 122 of alarm buzzer 120 is enlarged, the frequency characteristics of buzzer 120 are extended into the lower region so that the frequency characteristics are widened and the sound volume is stabilized.

Wristwatch 100, constructed and arranged in accordance with the invention, is also waterproof, notwithstanding that buzzer cover holes 109 are provided along the display surface. Alarm sound case 125 is inserted into barrel 101 from the rear side with sound tube 127 releasably retained within alarm opening 107 by a tube gasket 132 compressed between the periphery of sound tube 127 and retaining ring 129 at alarm opening 107. Alarm buzzer 120 is compressively retained in buzzer chamber 126 of alarm sound case 125 by a buzzer gasket 131 between side wall 121 of alarm buzzer 120 and the inside wall of buzzer chamber 126. Diaphragm 122 is hermetically sealed across the upper region of alarm buzzer 120. Thus, any water entering buzzer cover holes 109 cannot enter the interior of watch 100 from about the outside of alarm sound case 125 due to tube gasket 132. Additionally, any water entering buzzer cover holes 109 and passing to diaphragm 122 cannot pass side wall 121 or alarm gasket 131. Thus, a waterproof alarm wristwatch is obtained.

As shown in FIGS. 2 and 3, when wristwatch 100 is assembled, alarm sound case 125 is inserted into watch case 101 abutting plate 104 and alarm buzzer 120 is inserted into buzzer chamber 126. Sound tube 127 of alarm case 125 is inserted through opening 110 of plate 104 and sound tube 127 is retained in position within the watch barrel 101 by tube gasket 132 against retaining ring 129. This construction also leads to simplified assembly in that all parts can be assembled on plate 104 which is then inserted into watch barrel 101. Alternatively, a notch can be provided in plate 102 in place of opening 110 for guiding alarm sound case 125 into position.

Figure 4:
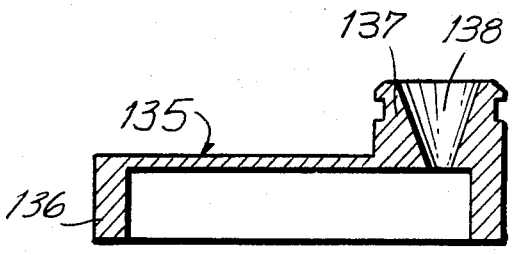
FIG. 4 is a cross-sectional view of a further embodiment of an alarm case for use in the wristwatch depicted in FIG. 2.

Referring now to FIG. 4, an alarm sound case 135, constructed and arranged in accordance with a second embodiment of the invention, is shown. Sound case 135 includes a substantially cylindrical buzzer chamber 136 having an open bottom surface and a substantially cylindrical sound tube 137 eccentrically disposed on the upper surface of buzzer chamber 136. Sound tube 137 communicates between buzzer chamber 136 and buzzer cover holes 109 on the display side of the wristwatch. In this embodiment, sound tube 137 is formed with an opening 138 having a conical shape with the base of the cone on the side adjacent to the display side of the watch. In this manner the resonance of the alarm sound can be increased in a horn effect. In a further embodiment, it is possible to engage sound tube 137 directly to watch barrel 101. Alternatively, as shown in FIG. 2, retaining ring 129 may be heat sealed to watch barrel 101 if it is desirable to reduce the wall thickness of watch barrel 101.

Alarm sound cases 125 and 135 can be constructed from individual cylindrical members. However, it is possible to reduce the cost of manufacture by integrally molding the alarm sound case from a plastic material. In yet a further embodiment, alarm sound case 125 can be formed directly with circuit case 117 as a unitary body. In wristwatch 100 shown in the drawings display panel 103 is a digital display, such as an LCD or LED. It is, of cours, within the scope of the invention to adapt the wristwatch and alarm for use with an analog display panel.

Figure 5:
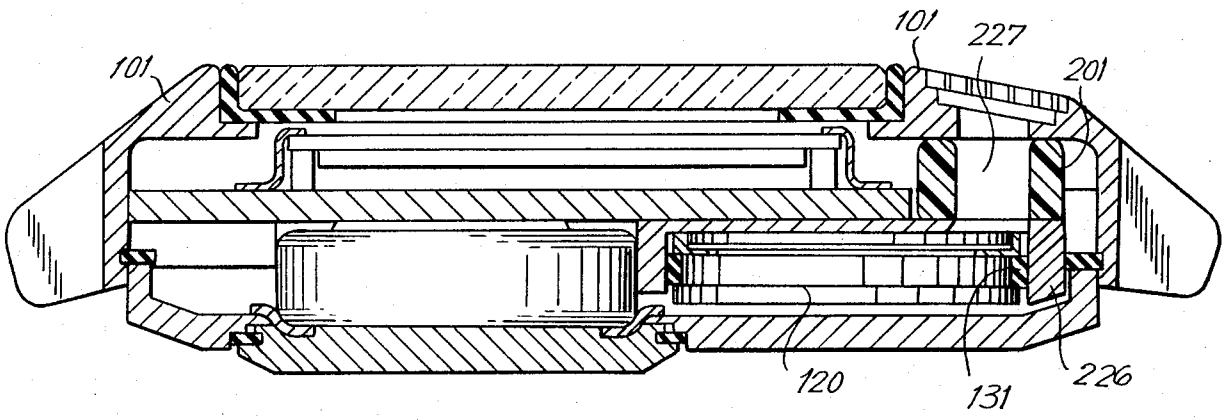
FIG. 5 is a cross-sectional view of an electric alarm wristwatch constructed in accordance with another embodiment of the invention.
Figure 6:
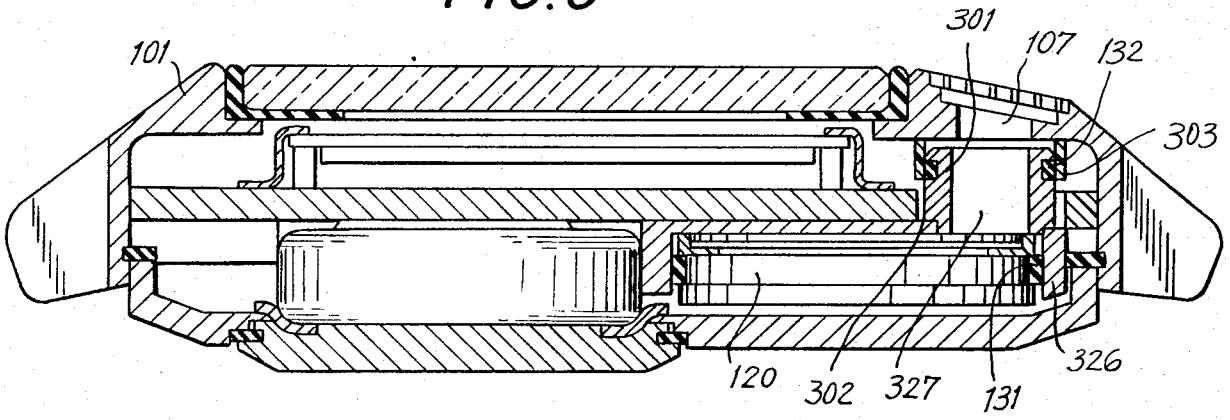
FIG. 6 is a cross-sectional view of an electronic alarm wristwatch constructed in accordance with a further embodiment of the invention.

Referring now to FIGS. 5 and 6, electronic wristwatches wherein the alarm sound cases are formed of individual cylindrical members are shown. In each figure, like reference numerals are used to identify like elements shown in the embodiment illustrated in FIG. 2.

Referring specifically to FIG. 5, a cylindrical sound tube 201 is independently formed in place of sound tube 127 of alarm sound case 125 shown in FIG. 2. A second larger cylindrical buzzer chamber 226 having a sound opening 227 in registration with the opening in cylindrical sound tube 201. The rear side of chamber 226 is open for receipt of alarm buzzer 120 which is compressively retained within chamber 226 by buzzer gasket 131.

Cylindrical sound tube 201 is formed of a resilient or gasket type material and is compressively retained between watch barrel 101 and alarm buzzer chamber 226. A water-tight seal is provided by this construction by the cooperation of cylindrical sound tube 201 and buzzer gasket 131. Furthermore, in the wristwatch constructed and arranged in accordance with this embodiment of the invention, retaining ring 129 shown in FIG. 2 is unnecessary in view of the elasticity of tube member 201. Thus, assembly of the wristwatch of FIG. 5 is easily assembled thus resulting in a cost reduction.

Referring now to FIG. 6, a further embodiment where an individual cylindrical sound tube is utilized in place of alarm sound case 125 of FIG. 2 is also shown. In this embodiment, cylindrical sound tube member 301 is positioned in watch case 101 in registration with buzzer opening 107. A second larger cylindrical buzzer chamber 326 having a sound opening 327 in registration with the opening through cylindrical sound tube 301 is utilized. In this embodiment, cylindrical sound member 301 and buzzer chamber 326 are formed of metal and hermetically joined by soldering along the plange region 302 adjacent to opening 327.

Cylindrical sound tube 301 is in registration with buzzer opening 107 in watch case 101 by a guiding member 303 and a water-tight seal is assured by tube gasket 132 compressed between tube member 301 and retaining ring 303. Alarm buzzer 120 is compressively retained within buzzer chamber 326 by gasket 131. Cooperation between tube gasket 132 and buzzer gasket 131 assure a water-tight seal. Additionally, constructing sound tube 301 and buzzer chamber 326 of metal permit reduction thickness of the side walls, by providing sufficient strength while permitting reduction in the overall size of the wristwatch.

As noted above, a wristwatch, including a display panel and alarm, constructed and arranged in accordance with the invention, may be reduced in size and thickness without reducing the alarm sound. Additionally, the wristwatch may be provided with a large display panel in the case of a digital display, or a dial in the case of an analog display, when it is desirable to display the alarm setting time and the current time simultaneously. Wristwatches constructed and arranged in accordance with the invention permit these advantageous design features. Furthermore, the volume of the sound and tonal quality of the alarm are stabilized because the alarm buzzer diaphragm can be increased in diameter. Additionally, improved reliability of wristwatches having uniform quality are obtained due to improved methods of manufacture. Moreover, a waterproof wristwatch is easily provided by positioning the gaskets in accordance with the invention. The size reductions possible, in accordance with the invention, permit sufficient miniaturization so that a ladies's wristwatch including an alarm, can be designed and manufactured.

A wristwatch, constructed and arranged in accordance with the invention, is superior to conventional alarm wristwatches in assembly and in servicing of the wristwatch. Additionally, the sound volume and quality can be varied and improved by varying the shape of the sound emitting portion and the sound directing portion of the alarm sound member. Furthermore, it is possible to improve assembly substantially by making the alarm case from a plastic material or by molding it as a unit with the circuit case. Thus, substantial cost savings during manufacturing may be obtained.

It will thus be seen that the objects set forth above, among those made apparent from the preceding description, are efficiently attained and, since certain changes may be made in the above construction without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

I claim:

1. An electrical alarm wristwatch comprising a watch case having a display surface, side walls and a back side, said display surface formed with a display opening and a buzzer opening therethrough, a battery having a bottom surface, watch circuit means driven by said battery and time display means including an electro-optical display panel driven by said watch circuit disposed within said watch case in registration with said display opening for viewing said display means, alarm buzzer means having a bottom surface and being disposed within said watch case and driven by said battery, said display means overlapping at least a portion of said buzzer means and at least a portion of said buzzer means being in uninterrupted registration with said buzzer opening, a sound case including a substantially cylindrical buzzer chamber having an open bottom surface and a substantially cylindrical sound tube eccentrically disposed on the upper surface thereof, and said substantially cylindrical buzzer chamber being hermetically engaged with said buzzer means, said substantially cylindrical sound tube disposed in said watch case communicating between said buzzer means and said buzzer opening for providing an uninterrupted route for transmitting the sound from said alarm buzzer means to said buzzer opening on the display side of said watch case, said upper surface of said cylindrical buzzer chamber having a diameter greater than said cylindrical sound tube, said electro-optical display panel overlapping said upper surface and wherein the bottom surface of said buzzer means and the bottom surface of said battery are disposed substantially on the same plane without overlapping each other.

2. The wristwatch of claim 1, further including a chamber for receipt of said alarm buzzer means, said buzzer chamber having a top wall with an opening in said top wall proximate the side wall of said chamber for communicating with said sound tube.

3. The wristwatch for claim 2, wherein said sound tube is formed of a resilient material and is compressively retained in said watch case between said buzzer openings and the opening in the top wall of said buzzer chamber.

4. The wristwatch of claim 3, wherein said alarm buzzer means is a substantially cylindrical alarm buzzer having a diaphragm at one end facing the display side of said watch case means and gasket means about said buzzer for providing a watertight seal for the wristwatch together with said compressible sound tube.

5. The wristwatch of claim 2, wherein said sound tube and sound chamber are formed of metal and hermetically joined together and said watch case means includes a hollow substantially cylindrical retainer portion in the region of said buzzer opening and gasket means for providing a watertight seal disposed about said sound tube and compressed between the retainer portion and said sound tube.

6. The wristwatch of claim 2, wherein said buzzer chamber and said sound tube are a unitary member of a plastic material.

7. The wristwatch of claim 2, wherein said buzzer chamber and sound tube are integrally formed within said watch case.

8. The wristwatch of claims 3, 5, 6 or 7, wherein said alarm buzzer diaphragm is recessed from the end of said alarm buzzer facing the display side of said watch case means.

9. The wristwatch of claim 2, wherein said sound tube has an opening therethrough which is substantially conical in shape with the base of the cone on the side towards the display side of said watch case means.

* * * * *